US012723577B2

(12) United States Patent
An et al.

(10) Patent No.: US 12,723,577 B2
(45) Date of Patent: Sep. 1, 2026

(54) CRYOGENIC LIQUID RECIPROCATING PUMP WITH A CYLINDER STRUCTURE FOR COOLING ASSISTANCE

(71) Applicant: KOREA INSTITUTE OF MACHINERY & MATERIALS, Daejeon (KR)

(72) Inventors: Byeung-cheol An, Daejeon (KR); Young Bog Ham, Daejeon (KR); Sangkwon Jeong, Daejeon (KR); KyoungJoong Kim, Daejeon (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 127 days.

(21) Appl. No.: 18/687,365

(22) PCT Filed: Nov. 25, 2022

(86) PCT No.: PCT/KR2022/018901
§ 371 (c)(1),
(2) Date: Mar. 5, 2025

(87) PCT Pub. No.: WO2023/096427
PCT Pub. Date: Jun. 1, 2023

(65) Prior Publication Data

US 2025/0198399 A1 Jun. 19, 2025

(30) Foreign Application Priority Data

Nov. 25, 2021 (KR) ..... 10-2021-0164445

(51) Int. Cl.
*F04B 15/08* (2006.01)
*F04B 53/08* (2006.01)
(Continued)

(52) U.S. Cl.
CPC ..... *F04B 15/08* (2013.01); *F04B 53/08* (2013.01); *F04B 53/10* (2013.01); *F04B 53/14* (2013.01); *F04B 53/16* (2013.01)

(58) Field of Classification Search
CPC ..... F04B 15/08; F04B 53/08; F04B 53/10; F04B 53/14; F04B 53/16
See application file for complete search history.

(56) References Cited

U.S. PATENT DOCUMENTS 4,239,460 A * 12/1980 Golz ..... F04B 3/003 417/259
4,873,913 A * 10/1989 Pruitt ..... F04B 39/045 92/158
(Continued)

FOREIGN PATENT DOCUMENTS

JP 2002-043732 A 2/2002
KR 10-0283156 B1 2/2001
(Continued)

OTHER PUBLICATIONS

International Search Report for corresponding International Application No. PCT/KR2022/018901 mailed Mar. 7, 2023.
(Continued)

*Primary Examiner* — Hoang M Nguyen
(74) *Attorney, Agent, or Firm* — Hauptman Ham, LLP

(57) ABSTRACT

A reciprocating pump for pressurizing a cryogenic liquid includes a pump housing, a suction chamber, a discharge chamber and a piston rod and a piston. The pump housing has a suction part into which a target liquid flows. The suction chamber is disposed in the pump housing, has an inner space divided into an upper space and a lower space, and is configured to inhale the target liquid then to pressurize the inhaled target liquid primarily. The discharge chamber is disposed under the suction chamber, has an inner space formed to be connected with the upper space of the suction
(Continued)

chamber, and is configured to receive the pressurized target liquid in the suction chamber, to pressurized the received target liquid secondarily and then to discharge the pressurized target liquid. The piston rod and the piston are configured to the target liquid in the suction chamber and the discharge chamber.

12 Claims, 6 Drawing Sheets

(51) Int. Cl.

| | |
|---|---|
| ***F04B 53/10*** | (2006.01) |
| ***F04B 53/14*** | (2006.01) |
| ***F04B 53/16*** | (2006.01) |

(56) References Cited

U.S. PATENT DOCUMENTS

| | | | | |
|---|---|---|---|---|
| 5,886,718 | A * | 3/1999 | Johnson | B41J 2/17509 347/85 |
| 2009/0308796 | A1* | 12/2009 | Ham | F04B 9/1176 210/110 |
| 2010/0302325 | A1* | 12/2010 | Shin | B41J 2/17509 347/85 |
| 2014/0241913 | A1* | 8/2014 | Puckett | F04B 15/08 417/375 |
| 2019/0145392 | A1* | 5/2019 | Brown | F04B 23/021 417/379 |

FOREIGN PATENT DOCUMENTS

| | | | |
|---|---|---|---|
| WO | 2021/164899 | A1 | 8/2021 |
| WO | 2021/164900 | A1 | 8/2021 |
| WO | 2021/164901 | A1 | 8/2021 |

OTHER PUBLICATIONS

Written Opinion for corresponding International Application No. PCT/KR2022/018901 mailed Mar. 7, 2023.

G. Petitpas, et al., "Liquid hydrogen pump performance and durability testing through repeated cryogenic vessel filling to 700 bar" International Journal of Hydrogen Energy, vol. 43, Issue 39, Sep. 27, 2018, pp. 18403-18420.

* cited by examiner

CRYOGENIC LIQUID RECIPROCATING PUMP WITH A CYLINDER STRUCTURE FOR COOLING ASSISTANCE

CROSS-REFERENCE TO RELATED APPLICATION

This application is a National Stage application under 35 U.S.C. § 371 of International Application No. PCT/KR2022/018901, filed on Nov. 25, 2022, which claims the benefit of Korean Patent Applications No. 10-2021-0164445, filed on Nov. 25, 2021. The disclosures of the prior applications are incorporated by reference in their entireties.

FIELD OF DISCLOSURE

The present disclosure of invention relates to a reciprocating pump for pressurizing a cryogenic liquid, and more specifically the present disclosure of invention relates to a cryogenic liquid reciprocating pump with a cylinder structure for cooling assistance.

DESCRIPTION OF RELATED TECHNOLOGY

As research and development on alternative energy has been actively conducted to respond to climate and environmental changes, interest in power generation using hydrogen energy and hydrogen fuel cell vehicles has continued to increase. In order to use hydrogen fuel, it is essential to build a charging infrastructure to store hydrogen and charge it so that it can be used when necessary. In this case, a pump is essential to pressurize and charge liquefied hydrogen stored in a cryogenic liquid state.

FIG. 1 illustrates a conventional reciprocating pump. For example, LINDE's pump 1 used to pressurize and discharge cryogenic liquefied hydrogen is simply illustrated. The above pump was introduced in the prior art, "Liquid hydrogen pump performance and durability testing through repeated cryogenic vessel filling to 700 bar" (G. Petitpas, et al., International Journal of Hydrogen Energy, Volume 43, Issue 39, 27 Sep. 2018, Pages 18403-18420). Reciprocating pumping chambers for cryogenic high-pressure discharge sometimes use a double-rod piston to connect with other equipment. In the case of the pump 1 of FIG. 1, a suction port 20 for suctioning liquefied hydrogen is formed on the suction chamber in which the piston 10 reciprocates. When the piston 10 rises, the liquefied hydrogen filled in the upper space of the piston is pushed into the distribution path formed in the piston rod and filled into the discharge chamber disposed at the lower part of the intake chamber. In addition, when the piston 10 descends, the liquefied hydrogen in the discharge chamber is pressurized and discharged into the discharge passage, and as the piston 10 passes through the suction port 20, the liquefied hydrogen flows into the upper space of the piston through the suction port 20.

Even in the case of a single chamber, control volumes are formed on both sides of the piston, but as in the prior art of FIG. 1, only one control volume above the piston is actually required for pumping. The control volume that requires pumping is used for pressurization, but during the suction process, backflow may occur momentarily due to excessive negative pressure or vacuum pressure, which can cause fatal failure of the pump. Additionally, if excessive pressure is applied to the control volume where pumping is not required, it acts as resistance, and excessive negative pressure can cause backflow. In the case of the prior art of FIG. 1, when the piston descends near bottom dead center, the control volume at the upper part of the chamber communicates with the external cryogenic liquid. Thus, when the piston lowers, a risk of negative pressure may occur in the control volume at the top of the chamber (requiring pumping), and at the same time, high pressure may occur in the control volume at the bottom (no pumping required). In order to finely create such negative and high pressures, very precise design and manufacturing are required. In addition, due to the nature of the device waiting at room temperature and operating at extremely low temperatures, the risk of failure increases, such as the risk of failure to operate as designed or damage due to shape deformation or increased brittleness of each part due to heat shrinkage. In addition, in the case of the prior art, since the port is formed on the curved side of the cylindrical chamber, it is difficult to apply a structure such as a valve here.

SUMMARY OF INVENTION

Technical Problem

The present invention is developed to solve the above-mentioned problems of the related arts. The present invention provides a cryogenic liquid reciprocating pump with a cylinder structure for cooling assistance. In the reciprocating pump, the structure has been improved so that each part, including a pumping chamber, may be smoothly cooled by the target liquid itself and at the same time problems such as negative pressure generation may be prevented, in the reciprocating pump for pumping a cryogenic target liquid.

Solution to Problem

According to an example embodiment, a reciprocating pump includes a pump housing, a suction chamber, a discharge chamber and a piston rod and a piston. The pump housing has a suction part into which a target liquid flows. The suction chamber is disposed in the pump housing, has an inner space divided into an upper space and a lower space, and is configured to inhale the target liquid received by the pump housing using a plurality of suction check valves and then to pressurize the inhaled target liquid primarily. The discharge chamber is disposed under the suction chamber in the pump housing, has an inner space formed to be connected with the upper space of the suction chamber, and is configured to receive the pressurized target liquid in the suction chamber, to pressurized the received target liquid secondarily and then to discharge the pressurized target liquid through a discharge line. The piston rod and the piston are configured to the target liquid in the suction chamber and the discharge chamber.

In an example, the upper and the lower spaces of the suction chamber may be divided by the piston, and the inner space of the discharge chamber may be connected to the upper space of the suction chamber by a connecting line formed at the piston rod.

In an example, the target liquid may be filled in the lower space of the suction chamber, so that the upper space of the suction chamber and the piston may be cooled down by the target liquid.

In an example, the suction chamber and the discharge chamber may sink in the target liquid received in the pump housing.

In an example, the suction check valve may be formed such that the target liquid moves toward the upper space of the suction chamber when the piston rod descends.

In an example, a lower portion of the suction chamber may be open.

In an example, an entire lower surface of the suction chamber may be open, or a plurality of idle valves may be formed on the lower surface of the suction chamber.

In an example, the piston rod may extend from an upper outer space of the suction chamber toward the upper space of the suction chamber. The piston rode may include at least one flow passage connected to the upper outer space of the suction chamber and the target liquid may flow into the flow passage.

In an example, at least a pair of flow passages may be arranged symmetrically with respect to an axis of the piston rod.

In an example, an upper space side end of the suction chamber of the flow passage may be closed by a blocking part.

In an example, a suction chamber heat sink pin may be formed on an outer surface of the suction chamber.

In an example, a discharge chamber heat sink pin may be formed on an outer surface of the discharge chamber.

Effects of the Invention

According to the present example embodiments, a valve is provided at the top of the pumping chamber constituting an upper control volume that requires pumping. In addition, a lower end of the pumping chamber, which constitutes a lower control volume where pumping is not required, is opened. Thus, it has a great effect in effectively preventing excessive or negative pressure that may occur in the pumping chamber.

In addition, mechanism is simple, so there is less risk of failure and maintenance is advantageous. Further, there is an effect of naturally cooling the inner wall of the piston pumping chamber by using the cryogenic target liquid filled in the lower control volume of the cylinder that is not actually used for pumping.

Figure 1:
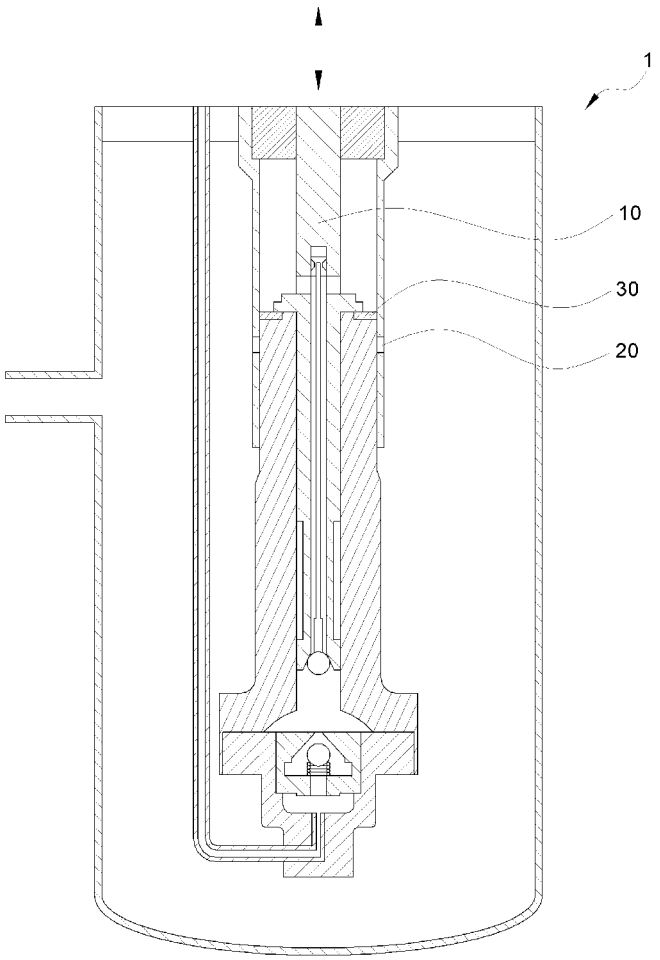
FIG. 1 is a cross-sectional view illustrating the conventional cryogenic reciprocating pump.

| * Reference numerals | |
|---|---|
| 1: conventional pump | 10: (conventional) piston |
| 20: suction port | 30: dynamic seal |
| 1000: reciprocating pump | 100: pump housing |
| 110: suction part | 200: suction chamber |
| 205: suction chamber | 210: suction check valve |

-continued

| * Reference numerals | |
|---|---|
| heat sink pin | |
| 220: idle valve | 300: discharge chamber |
| 305: discharge chamber heat sink pin | 315: discharge line heat sink pin |
| 310: discharge line | 400: piston |
| 410: connecting line | 450: piston rod |
| 451: flow passage | 452: blocking part |

DETAILED DESCRIPTION

The invention is described more fully hereinafter with Reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the invention is described more fully hereinafter with reference to the accompanying drawings, in which embodiments of the invention are shown.

Figure 2:
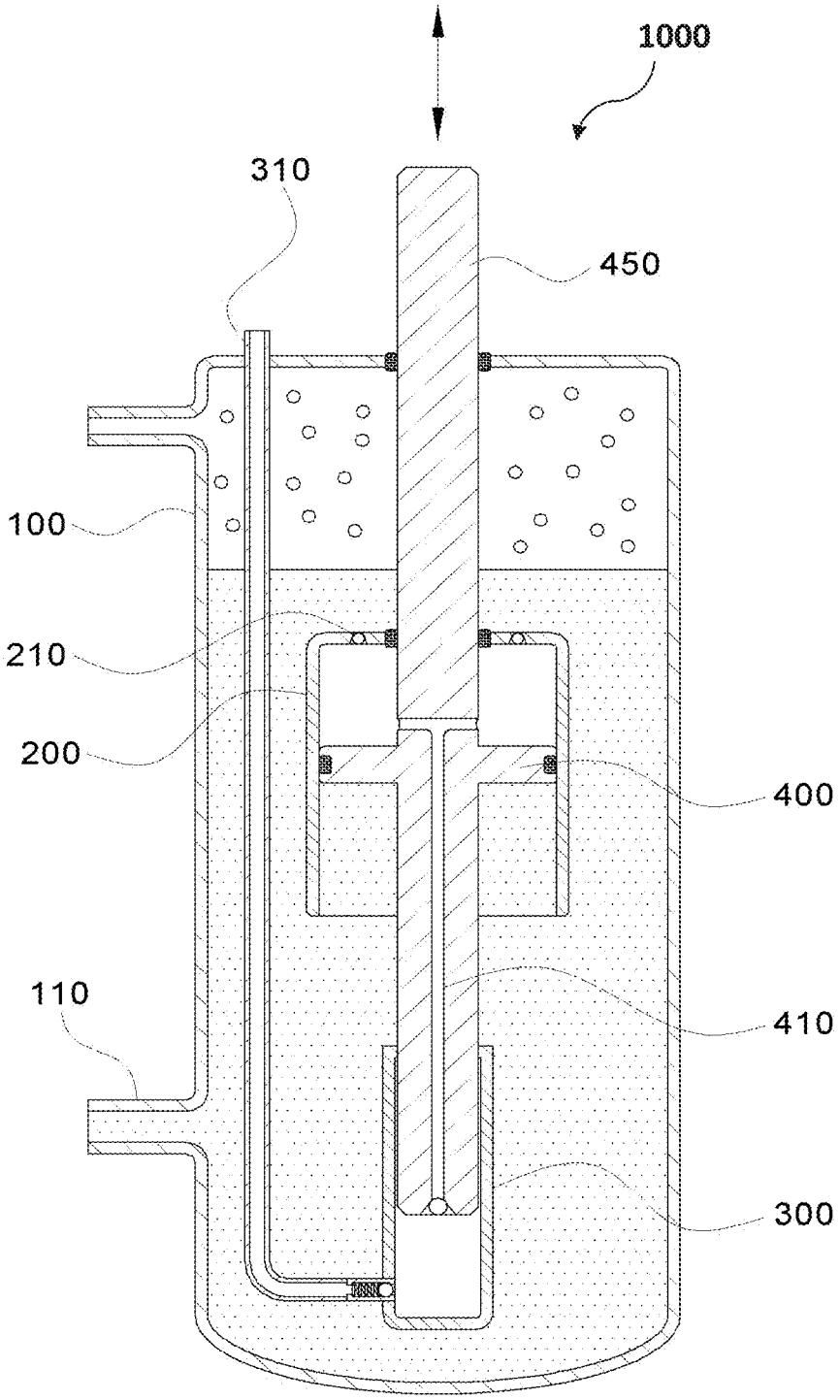
FIG. 2 is a conceptual view illustrating a reciprocating pump according to an example embodiment of the present invention.

FIG. 2 is a conceptual view illustrating a reciprocating pump according to an example embodiment of the present invention.

The reciprocating pump 1000 according to the present example embodiment is explained referring to FIG. 2. The reciprocating pump 1000 includes a pump housing 100, a suction chamber 200, a discharge chamber 300, a piston 400 and a piston rod 450.

The pump housing 100 receives a target liquid, and a suction part 110 is formed at a side of the pump housing 100 as illustrated in the figure, and the target liquid flows into the suction part 110. The target liquid may be liquefied hydrogen, but not limited thereto, and the target liquid may be cryogenic liquids such as liquid nitrogen, liquid oxygen, etc. Here, even if the entire space within the pump housing 100 is initially completely filled with the target liquid, as heat is generated for various reasons, the target liquid is evaporated and a boil-off gas is generated, as shown in the figure. Thus, the boil-off gas takes up some space of the pump housing 100. If the space occupied by the boil-off gas becomes excessively large, the pump may not operate smoothly. Thus, as illustrated in the figure, a gas return line may be provided on an upper side of the pump housing 100 to discharge the gas at an appropriate time.

The suction chamber 200 is disposed inside of the pump housing 100. The suction chamber 200 inhales the target liquid received by the pump housing 100 toward an upper space, and primarily pressurizes the target liquid. To perform the operation, the suction chamber 200 is divided into an upper space and a lower space by the piston 400. The upper space and the lower space are isolated with each other. A plurality of suction check valves 210 is formed at the upper portion of the suction chamber 200 and then the target liquid moves into the suction chamber 200 when the piston rod 450 descends.

The discharge chamber 300 is disposed under the suction chamber 200 in the pump housing 100. The discharge chamber 300 receives the pressurized target liquid from the suction chamber 200, and secondarily pressurizes the target liquid and then discharges the target liquid through a discharge line 310. Here, for receiving the pressurized target liquid from the suction chamber 200, an inner space of the discharge chamber 300 is connected to the upper space of the suction chamber 200 through a connecting line 410 which is formed through the piston rod 450. A check valve is disposed at a discharge end of the connecting line 410, which is a connecting end with the discharge chamber 300, so that the target liquid flowing from the suction chamber 200 is discharged toward the discharge chamber 300 but an opposite flow of the target liquid is limited. In addition, a check valve is disposed at an inhaling end of the discharge line 310, which is a connecting end with the discharge chamber 300, so that the target liquid inside of the discharge chamber 300 is discharged to outside but an opposite flow of the target liquid is limited.

The piston rod 450 and the piston 400 are formed integrally, and the piston rod 450 is protruded outside of the pump housing 100 and then the piston rod 450 moves up and down by a power from outside. Since the piston rod 450 and the piston 400 are formed integrally, the piston 400 moves up and down together with the piston rod 450 and the piston 400 directly pressurizes the target liquid inside of the suction chamber 200.

Here in the present example embodiment, the target liquid is always filled in the lower space of the suction chamber 200, and thus the upper space of the suction chamber 200, the piston 400 and the piston rod 450 are always cooled down by the target liquid. To perform the cooling, a lower portion of the suction chamber 200 may be open. Here, an entire lower surface of the suction chamber 200 is open.

Figure 3:
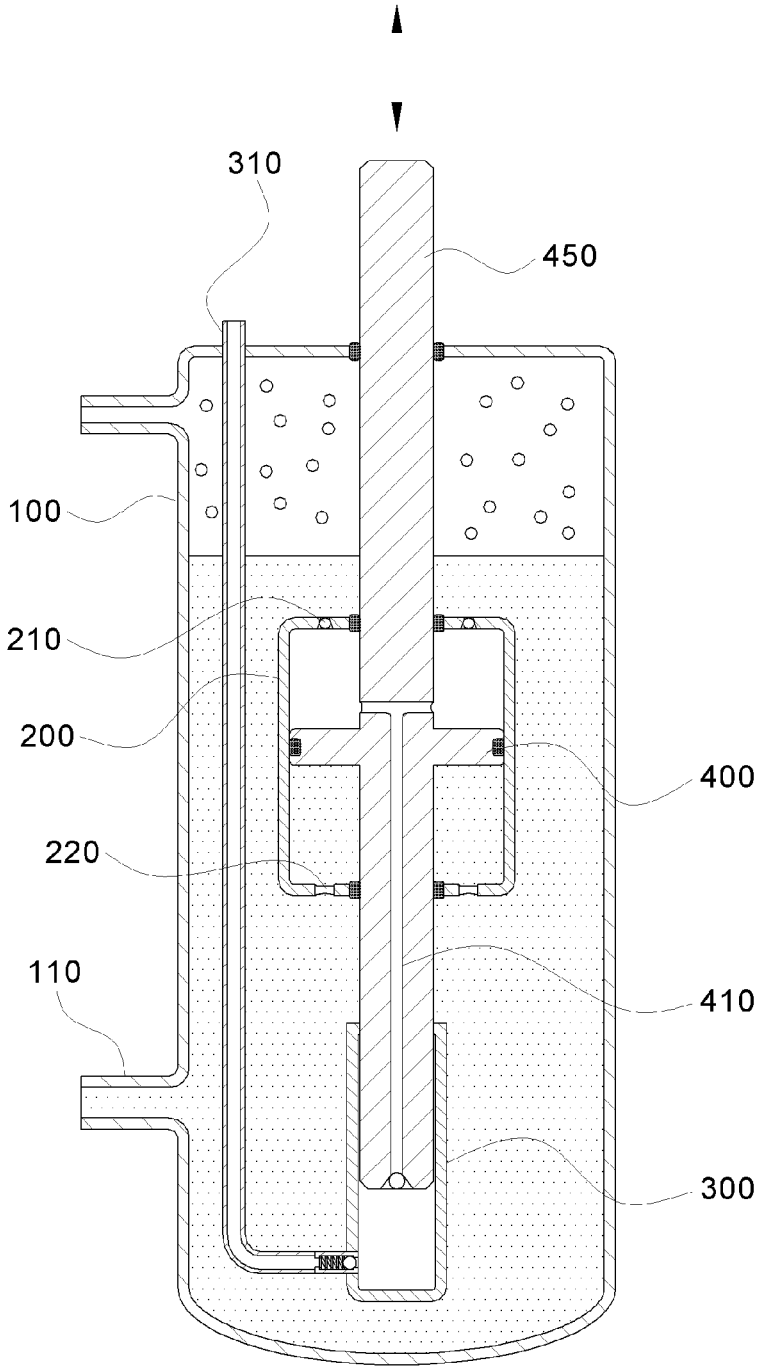
FIG. 3 is a conceptual view illustrating a reciprocating pump according to another example embodiment of the present invention.

FIG. 3 is a conceptual view illustrating a reciprocating pump according to another example embodiment of the present invention.

The reciprocating pump according to the present example embodiment is substantially same as the reciprocating pump of FIG. 2, except for a plurality of idle valves 220 formed on a lower surface of the suction chamber 200, and thus same reference numerals are used for same elements and any repetitive explanation will be omitted.

Referring to FIG. 3, in the reciprocating pump according to the present example embodiment, the plurality of idle valves 220 is formed at the lower surface of the suction chamber 200, and thus the target liquid flows freely without resistance and always fills the lower space of the suction chamber 200.

In FIG. 3, the idle valve 220 is illustrated to be the simplest shape which is the slit type, but flow passages of various shapes such as perforated type, nozzle type, donut type, port type, etc. may be applied.

In addition, in order to increase the cooling effect and at the same time allow the target liquid to be smoothly sucked into the upper space of the suction chamber 200, in the reciprocating pump 1000, the suction chamber 200 and the discharge chamber 300 sink in the target liquid received by the pump housing 100.

According to the above example embodiments, the reciprocating pump has the above mentioned structure and thus negative pressure problem may be easily solved. Hereinafter, referring to FIG. 4 and FIG. 5, the movement of the target liquid and other operation according to the up and down movement of the piston will be explained in detail.

Figure 4:
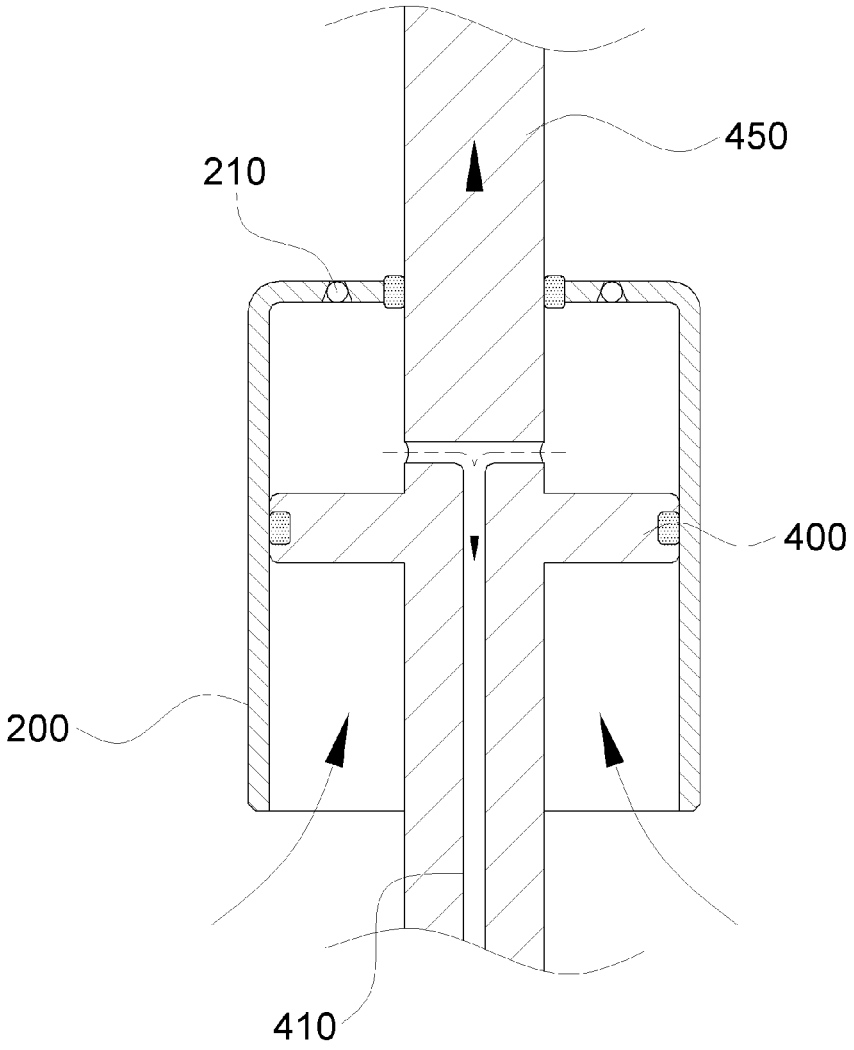
FIG. 4 is a conceptual view for explaining a moving state of a target liquid when a piston rises in the reciprocating pump of FIG. 2 or FIG. 3.
Figure 5:
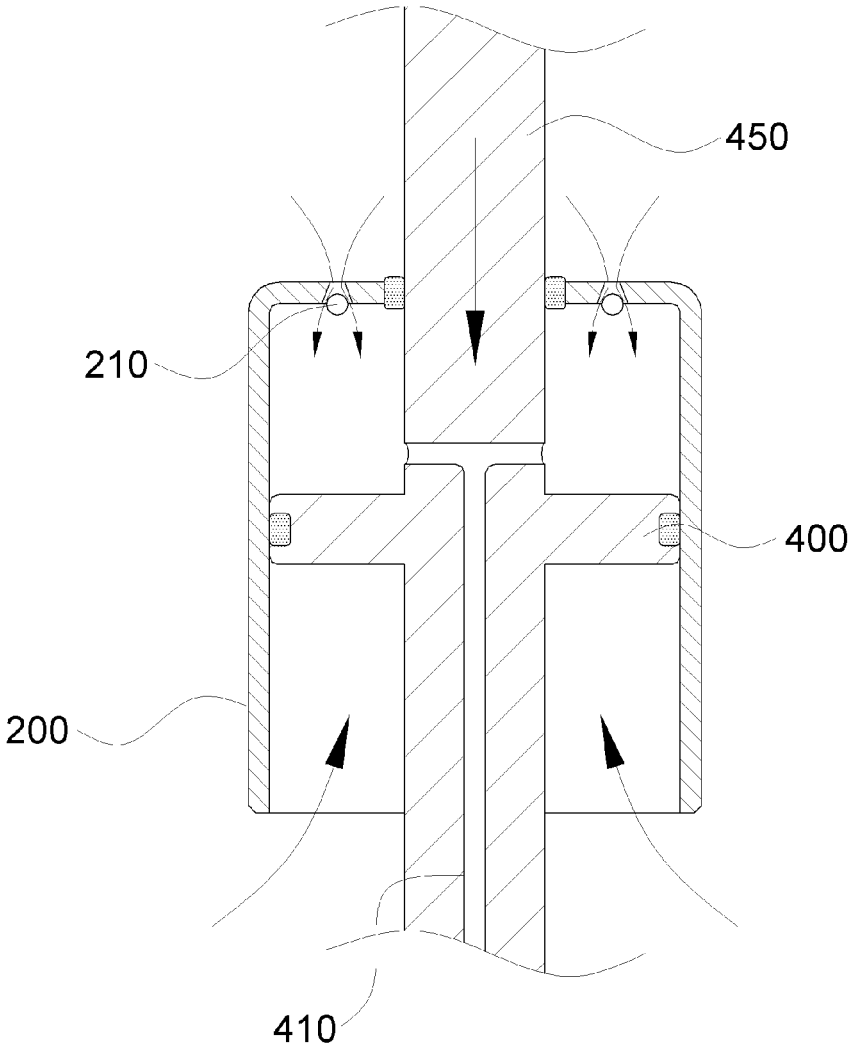
FIG. 5 is a conceptual view for explaining a moving state of the target liquid when the piston descends in the reciprocating pump of FIG. 3 or FIG. 3.

FIG. 4 is a conceptual view for explaining a moving state of a target liquid when a piston rises in the reciprocating pump of FIG. 2 or FIG. 3. FIG. 5 is a conceptual view for explaining a moving state of the target liquid when the piston descends in the reciprocating pump of FIG. 3 or FIG. 3.

Referring to FIG. 4, the operation of the elements is explained as the piston 400 rises.

As the piston 400 rises, the volume of the upper space of the suction chamber 200 is decreases and then the target liquid received in the upper space is primarily pressurized. Thus, the target liquid received in the upper space of the suction chamber 200 is delivered to the discharge chamber 300 through the connecting line 410 formed in the piston rod 450. Here, as illustrated in the figure, the suction check valve 210 is closed when the piston rises, since the pressure of the upper space is larger than an outer pressure. Here, the suction check valve 210 is open when the pressure of the upper space is lower than the outer pressure.

The target liquid is sucked and inhaled into the pump housing 100 through the suction part 110, by the volume increased due to the rise of the piston 400. Here, in the present example embodiment, since the lower space of the suction chamber 200 is open, as illustrated in FIG. 4 as a big arrow, the target liquid freely flows into the lower space of the suction chamber 200 and the target liquid is always filled in the lower space of the suction chamber 200.

Then, referring to FIG. 5, the operation of the elements is explained as the piston 400 descends.

As the piston 400 descends, referring to FIG. 2 and FIG. 3, the target liquid received in the discharge chamber 300 is secondarily pressurized by the piston rod 450, and thus the target liquid is discharged outside of the reciprocating pump 1000 through the discharge line 310 connected to the discharge chamber 300.

Referring to FIG. 5, the phenomenon that occurs within the suction chamber 200 is as follows. As the piston 400 descends the pressure of the upper space 200 decreases as the volume of the upper space 200 increases. As explained above, since the suction check valve 210 is open when the pressure of the upper space is lower than the outer pressure, the suction check valve 210 is open and then the target liquid outside flows into the upper space of the suction chamber 200. Here, if the suction chamber 200 is not completely submerged in the target liquid, a problem may occur with vaporized gas flowing into the suction check valve 210. Thus, the suction chamber 200 should be completely submerged in the target liquid.

When the lower portion of the suction chamber 200 is open, the force may be applied to the target liquid received in the pump housing 100 as the piston 400 descends. However, referring to FIG. 2 and FIG. 3, the target liquid may not be completely filled in the pump housing 100 and in this case, the level of the target liquid merely rises in the space in which the evaporated gas of the target liquid is filled but the pressure remains almost the same. Thus, no significant resistance is received in the lower space when the piston 400 descends.

Accordingly, in the reciprocating pump 1000 according to the present example embodiment, the pressure of the upper space of the suction chamber 200 is increases as the piston 400 rises, and then the target liquid is primarily pressurized to be delivered to the discharge chamber 300. In addition, as the piston 400 descends, the target liquid inside of the discharge chamber 300 is secondarily pressurized by the piston rod 450 and at the same time, the target liquid flows into the upper space of the suction chamber 200 with the suction check valve 210 open, and thus the target liquid as much as the amount of the discharged target liquid is filled in the upper space of the suction chamber 200 again. The above operation is repeatedly performed, and thus the operation of the reciprocating pump 1000 to suck in the target liquid and discharge it to a desired external device is performed smoothly.

To sum up, when the piston 400 rises, the suction check valve 210 is closed and the pressurization for the upper space is smoothly performed for the discharge. However, when the piston 400 descends, the suction check valve 210 is open and the amount of the target liquid discharged smoothly flows into the upper space and the negative pressure generated in the conventional reciprocating pump is not generated in the present example embodiment.

Conventionally, to solve the negative pressure problem, a dynamic seal that moves up and down with the piston was used. However, in the case of dynamic seals, there was a problem that they were easily damaged, especially in cryogenic environments, due to constant friction with the inner wall of the suction chamber. In contrast, in the present example embodiment, the reciprocating pump includes the suction check valve. Thus, in addition to solving the negative pressure problem, design and manufacturing may be greatly simplified by not adding a new configuration to the contact area between the piston and the suction chamber. Further, the risk of damage is greatly reduced, and additional effects such as reduced maintenance costs may be achieved.

In the present example embodiment, as explained above, basically, the suction chamber 200 is always immersed in the cryogenic target liquid, and at the same time, the lower space of the suction chamber 200 is always filled with the cryogenic target liquid. Then, frictional heat between the piston and suction chamber may be naturally and directly cooled by the target liquid at extremely low temperature. For example, in the rising of the piston 400, the cryogenic target liquid is sucked into the suction chamber 200 to absorb frictional heat of the inner wall without forming low or negative pressure. In the descending of the piston 400, the cryogenic target liquid that has absorbed the heat may be discharged out of the suction chamber 200 without creating high pressure, thereby achieving natural and effective cooling.

Further, in the reciprocating pump according to the present example embodiments, with respect to the suction chamber 200, which is in the form of a cylinder and has a curved side surface, the suction check valve 210 is formed on the upper surface, that is, the flat portion. In the conventional technology, since the suction port is formed on the curved side of the chamber, there was considerable difficulty in applying structures such as valves. However, in the present example embodiment, the suction port is formed at the portion having the plane surface, so that the valve structure such as the suction check valve 210 may be easily applied.

Figure 6:
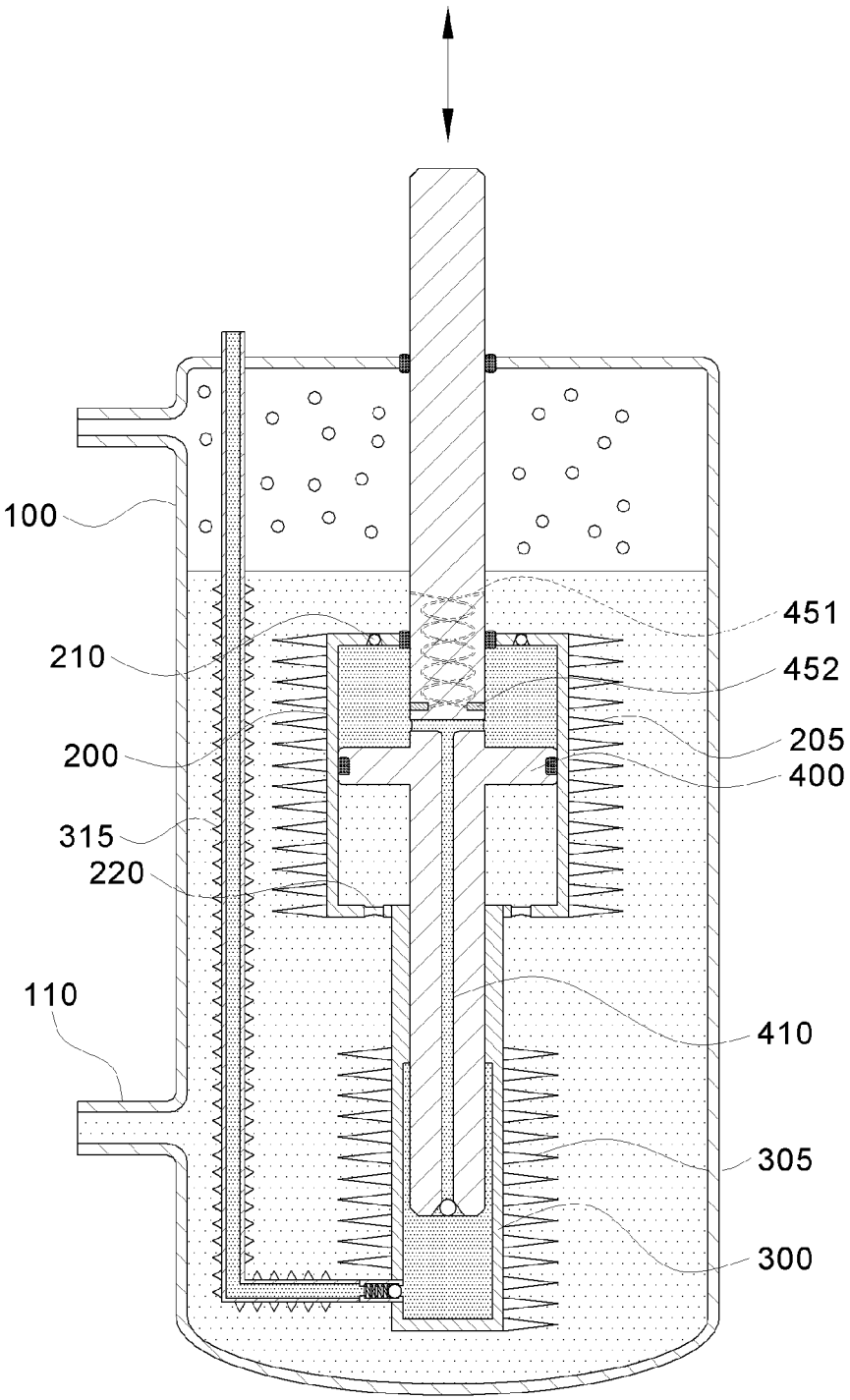
FIG. 6 is a conceptual view illustrating a reciprocating pump according to still another example embodiment of the present invention.

FIG. 6 is a conceptual view illustrating a reciprocating pump according to still another example embodiment of the present invention.

In the present example embodiment, subsidiary structures are further included in the reciprocating pump for the additional cooling, and the subsidiary structures are further illustrated to FIG. 3.

Referring to FIG. 6, a flow passage 451 having a spiral shape is explained first. The piston rod 450 extends from the upper outer space of the suction chamber 200 toward the upper space of the suction chamber 200. The piston rod 450 includes at least one flow passage 451 formed in connection with the upper outer space of the suction chamber 200 to allow the target liquid to flow in. Since the uppermost end of the piston rod 450 is exposed to outside, external heat intrusion conducted from the outside may have a direct adverse effect on the target liquid in the upper space of the suction chamber 200 through the piston rod 450. The flow passage 450 is configured to prevent the external heat intrusion, and the cryogenic target liquid flowing through the flow passage 451 pre-cools the external heat conducted through the piston rod 450. Thus, the risk that external heat intrusion due to conduction may be transmitted to the target liquid in the suction chamber 200 and have a negative effect may be removed in advance. In order for the above cooling action to occur effectively, at least one pair of the flow passage 451 may be formed to be symmetrically arranged about the axis of the piston rod 450.

In addition, as illustrated in the figure, the range in which the flow passage 451 is formed corresponds similarly to the range in which the piston rod 450 moves through the upper surface of the suction chamber 200. The frictional heat generated as the piston rod 450 moves may also be cooled and removed by the cryogenic target liquid in the flow passage 451.

In this way, the target liquid flowing into the flow passage 451 has a great effect of cooling the external heat intrusion through the piston rod 450, but when the flow passage 451 is connected to the inner space of the suction chamber 200, there is a risk of adversely affecting pumping operation. Thus, the end of the flow passage 451 on the upper space side of the suction chamber 200 should be closed by the blocking part 452, so that the flow passage 451 is connected to the outside, which is unrelated to the pumping, allowing free inflow and outflow of target liquid, but the flow passage 451 is not connected to the inside, which may affect the pumping. The blocking part 452 may be formed via a plugging welding.

Heat sink pins 205, 305 and 315 are explained below. The lower portion of the suction chamber 200 is open, so that the lower space is always filled with cryogenic target liquid and the cooling is performed naturally and constantly. Here, to increase the cooling effect, a suction chamber heat sink pin 205 may be formed to enlarge a heat exchange area. The target liquid flows into the discharge chamber 300 and here, the target liquid contains the heat due to compression heat and it is necessary to discharge the heat to the outside. Thus, a discharge chamber heat sink pin 305 may be formed to enlarge a heat exchange area in the discharge chamber 300. In addition, if the required temperature of the pumped and high pressurized target liquid is low, additional cooling may be required in the discharge line 310. Thus, a discharge line heat sink pin 305 may be formed in the discharge line 310. Each of the heat sin pins 205, 305 and 315 may have various shapes such as a horizontal shape, a vertical shape, a rod shape, a plate shape, a thin-film shape and so on, and may be appropriately selected according to need.

According to the present example embodiments, a valve is provided at the top of the pumping chamber constituting an upper control volume that requires pumping. In addition, a lower end of the pumping chamber, which constitutes a lower control volume where pumping is not required, is opened. Thus, it has a great effect in effectively preventing excessive or negative pressure that may occur in the pumping chamber.

In addition, mechanism is simple, so there is less risk of failure and maintenance is advantageous. Further, there is an effect of naturally cooling the inner wall of the piston pumping chamber by using the cryogenic target liquid filled in the lower control volume of the cylinder that is not actually used for pumping.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A reciprocating pump comprising:

a pump housing having a suction part into which a target liquid flows;

a suction chamber disposed in the pump housing, having an inner space divided into an upper space and a lower space, and configured to inhale the target liquid received by the pump housing using a plurality of suction check valves and then to pressurize the inhaled target liquid primarily;

a discharge chamber disposed under the suction chamber in the pump housing, having an inner space formed to be connected with the upper space of the suction chamber, and configured to receive the pressurized target liquid in the suction chamber, to pressurize the received target liquid secondarily and then to discharge the pressurized target liquid through a discharge line; and a piston rod and a piston configured to the target liquid in the suction chamber and the discharge chamber, wherein a lower portion of the suction chamber is open.

2. The reciprocating pump of claim 1, wherein the upper and the lower spaces of the suction chamber is divided by the piston, and the inner space of the discharge chamber is connected to the upper space of the suction chamber by a connecting line formed at the piston rod.

3. The reciprocating pump of claim 1, wherein the target liquid is filled in the lower space of the suction chamber, so that the upper space of the suction chamber and the piston are cooled down by the target liquid.

4. The reciprocating pump of claim 3, wherein the suction chamber and the discharge chamber sink in the target liquid received in the pump housing.

5. The reciprocating pump of claim 1, wherein the suction check valve is formed such that the target liquid moves toward the upper space of the suction chamber when the piston rod descends.

6. The reciprocating pump of claim 1, wherein an entire lower surface of the suction chamber is open, or a plurality of idle valves is formed on the lower surface of the suction chamber.

7. The reciprocating pump of claim 1, wherein the piston rod extends from an upper outer space of the suction chamber toward the upper space of the suction chamber, wherein the piston rode comprises at least one flow passage connected to the upper outer space of the suction chamber and the target liquid flows into the flow passage.

8. The reciprocating pump of claim 7, wherein at least a pair of flow passages is arranged symmetrically with respect to an axis of the piston rod.

9. The reciprocating pump of claim 7, wherein an upper space side end of the suction chamber of the flow passage is closed by a blocking part.

10. The reciprocating pump of claim 1, wherein a suction chamber heat sink pin is formed on an outer surface of the suction chamber.

11. The reciprocating pump of claim 1, wherein a discharge chamber heat sink pin is formed on an outer surface of the discharge chamber.

12. The reciprocating pump of claim 1, wherein a discharge line heat sink pin is formed on an outer surface of the discharge line.

* * * * *